United States Patent [19]

Hyde

[11] Patent Number: 4,611,514

[45] Date of Patent: Sep. 16, 1986

[54] MULTI-PURPOSE SOCKET RATCHET WRENCH

[76] Inventor: Henry D. Hyde, 3229 Park Hills Dr., Austin, Tex. 78746

[21] Appl. No.: 812,749

[22] Filed: Dec. 23, 1985

[51] Int. Cl.[4] ..... B25B 13/46

[52] U.S. Cl. ..... 81/60

[58] Field of Search ..... 81/60, 177.1, 177.9, 81/177.2

[56] References Cited

U.S. PATENT DOCUMENTS

| | | | |
|---|---|---|---|
| 952,436 | 3/1910 | Miller | 81/60 |
| 1,331,956 | 2/1920 | Cross | 81/60 |
| 3,383,962 | 5/1968 | Harris | 81/177.9 |
| 4,463,632 | 8/1984 | Parke | 81/177.9 |

FOREIGN PATENT DOCUMENTS

| | | | |
|---|---|---|---|
| 1906333 | 2/1969 | Fed. Rep. of Germany | 81/60 |

*Primary Examiner*—James L. Jones, Jr.

*Attorney, Agent, or Firm*—John N. Shaffer, Jr.

[57] ABSTRACT

A multipurpose socket ratchet wrench with a socket recess above the ratchet and a socket probe below the ratchet attached to a grip lever handle capable of attaining a plurality of secured angled positions relative to the ratchet head. A forked lever balance auxiliary handle is provided that is attachable over the grip lever handle end or the ratchet head end to provide for a variety of useful mechanical configurations. Further, a multiportion extension drive and a rapid cranking means are provided which further multiply the variety of configurations which can be safely and conveniently utilized with this device.

3 Claims, 17 Drawing Figures

MULTI-PURPOSE SOCKET RATCHET WRENCH

BACKGROUND OF THE INVENTION

This invention relates to an improved multi-purpose socket wrench driver tool having a variety of versatile configurations making it convenient and practical to remove and fasten bolts and nuts simply and easily.

Both manual and automatically driven socket mechanisms have been known in the art for quite some time. The disadvantage of previous devices is that they were generally specialized so that one job would necessitate the utilization of a variety of different tools. Additionally, previous devices were not flexible in allowing for different handle angles to be safely and securely accessed. As a result of the inability of previous "universal joint" devices to provide for a variable but fixed angle, the normal socket wrenches would twist and fall away from the work piece. Additionally, previous devices were not adaptable to attaching extension handles so that the use of unsafe "cheater bars" is commonplace.

Thus, there is a need in the art for providing a multi-purpose socket wrench driver tool having at least three major interchangeable parts to provide a variety of versatile configurations to make it convenient and practical to remove and fasten nuts and bolts simply and easily.

Another object of the invention is to provide an interchangeable socket ratchet wrench designed to have the ratchet apparatus in the exact center of the tool having equal weighted arms balanced opposite each other on either side of the socket apparatus so as to allow a rotating spinner action that makes it easier to remove and to fasten bolts, an action that is performed by the common cross-shaped wrench that is used in removing automobile tires.

Still another object is to provide a socket spinner wrench with a positive locking means to be used with interchangeable parts that will not have a tendency to come apart as is frequently found in the spring-loaded ball fasteners on most common ratchets, by providing a specific means that has to be operated by the user before the parts release.

A further object is to provide a spinner ratchet wrench that has a means for holding the wrench in the user's hand while the spinner action is being used with no danger of friction damage to the hand, as found in some other spinner wrenches.

Another important object is to provide a spinner ratchet wrench system that is conventional in operation and that can be readily perceived and understood by the user without long explanation.

Another object is to provide a wrench that will readily adapt to present wrench systems and fit into their adapter and extension parts.

A further object of the invention is to provide an extension handle which when installed is locked into place, providing an added level of safety as well as utility.

Another object of the invention is to provide a multi-purpose wrench that may be configured to transmit torque through an extension that passes through a handle which remains stationery within the operator's hand while the operator holds it to a specific piece of work.

A further object of the invention is to provide a multi-purpose socket wrench that can be configured to transmit torque through an extension to which an outer handle may be rigidly affixed to the extension at the operator's desire so that the operator may pass torque directly to the extension through the enclosing handle.

SHORT STATEMENT OF THE INVENTION

Accordingly, an improved multi-purpose socket ratchet wrench of the present invention includes a ratchet head, a ratchet head pivot boss, a cylindrically shaped wrist pin which extends out of the ratchet head pivot boss in both directions, a pair of wrist pin pivot bosses mounted on either side of the ratchet head pivot boss, a cross-bar guard attached to the wrist pin pivot bosses such that the ratchet head pivot boss can be rotated freely with respect to the cross-bar guard, a grip lever handle, a forked lever, balance auxiliary handle and a multi-port position rotatable handle drive. As described, the invention enables the user to attach another drive or some other tool directly to the head of the ratchet. That is, the head of the ratchet has a receptacle which can be utilized for any conventional drive tool and, as previously stated, the drive tool can be mounted directly on top of the ratchet head. In its simplest formation, the device consists of a ratchet head with a grip lever handle which is capable of a plurality of fixed angled locations with respect to the ratchet head. The ratchet head has a socket recess on top and a socket probe on the bottom. A cross-bar guard on the grip lever handle protects the operator's hands while utilizing the device and also provides an auxiliary handle slot into which the auxiliary handle may be securely located.

Attaching the forked lever balance auxiliary handle from the ratchet end of the device allows the operator to create a spinner wrench much the same as a tire tool device so that the instrument can be spun like a flywheel to secure or detach a bolt or nut from its location.

Attaching the auxiliary handle to the grip lever handle end of the device provides for a secure, safe extension and obviates the need for a dangerous "cheater bar". In this configuration, the ratchet head is free to be tilted in a plurality of angles so that a secure purchase may be obtained for any given situation without fear of slippage as is common when using "universal joints".

The possibility of a further configuration for the device is provided by means of a fixed socket recess in the center of the grip lever handle. Inserting a rotatable handle drive of ordinary design into this fixed socket recess provides a handle which is perpendicular to the grip lever handle and provides a "crank drive" configuration so that the socket probe in the ratchet head when connected with a socket or some other device may be utilized to crank the screw or bolt into position.

Yet another configuration is provided by inserting the rotatable handle drive into the socket recess in the top of the ratchet head. In this configuration, when the socket probe in the ratchet head is placed into contact with a socket and a subsequently a bolt, etc., the grip lever handle may be utilized as a handle on a ratchet moved back and forth while the operator's hand on the rotatable handle drive remains stationery.

Still another configuration is provided by inserting a rapid cranking means into the socket recess in the top of the ratchet head to provide a rapidly rotatable means to run nuts/bolts on and off.

BRIEF DESCRIPTION OF THE DRAWINGS

Other objects, features, and advantages of the present invention will become more fully apparent from the following detailed description of the preferred embodiment, the appended claims and the accompanying drawings in which:

FIG. 1 contains five views of a preferred embodiment of the multi-purpose socket ratchet wrench, including:

FIG. 2 illustrates the device in several configurations, including:

FIG. 3 illustrates the device in several additional configurations, including:

FIG. 4 illustrates the device in its various positions when utilized with the auxiliary handle, including:

FIG. 4C also illustrates the flexibility of the ratchet head to be moved to a plurality of non-straight positions when the auxiliary handle is used from the grip lever handle end.

DETAILED DESCRIPTION OF THE PRFERRED EMBODIMENT

Figure 1A:
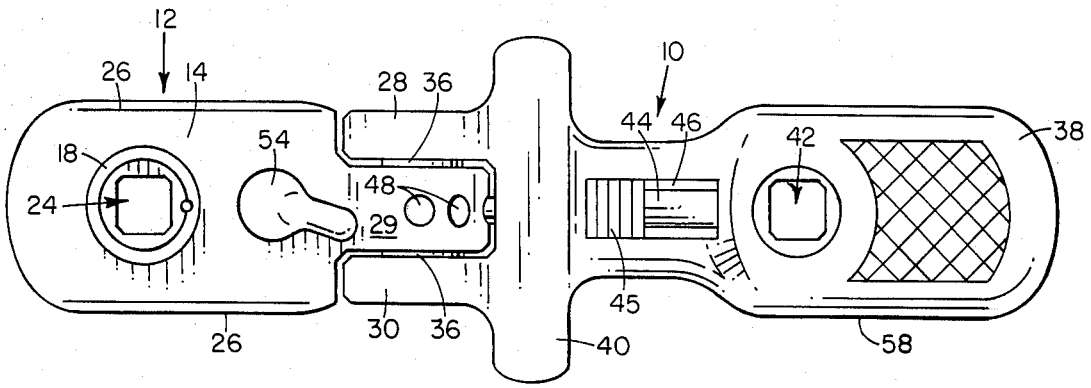
FIG. 1A is a top view of the device illustrating the ratchet head and the grip lever handle.

The preferred embodiment of the present invention is illustrated by way of example in FIGS. 1–4. In FIG. 1, multi-purpose socket ratchet wrench 10 includes a ratchet head 12 which includes a ratchet head casing 14 which contains a reversable ratchet wheel and pall mechanism 16 (not shown, see FIG. 3B). Also illustrated in socket wrench mandrel 18 located on the top of ratchet head 12. On the bottom of ratchet head 12 is located tool mount-adapter drive probe 20 (shown in FIG. 1B) and tool retention-release mechanism 22. The top of ratchet head 12 contains socket recess adapter drive receptacle 24. The sides of ratchet head 12 are provided with ratchet head rails 26 utilized in conjunction with an attachable-detachable auxiliary handle to be described hereafter.

Figure 1B:
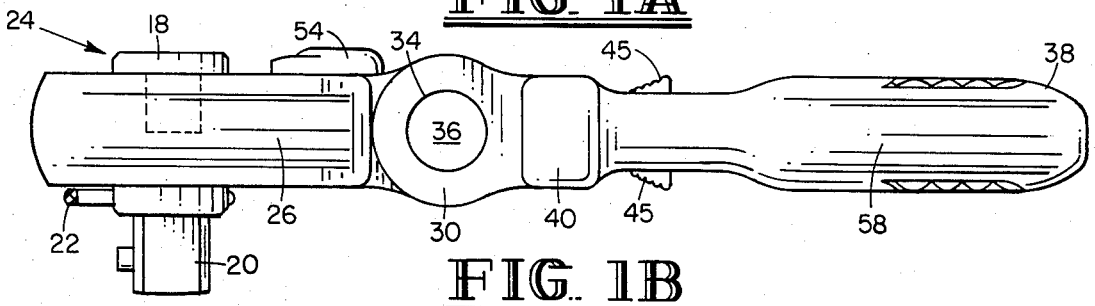
FIG. 1B is a side view.
Figure 1C:
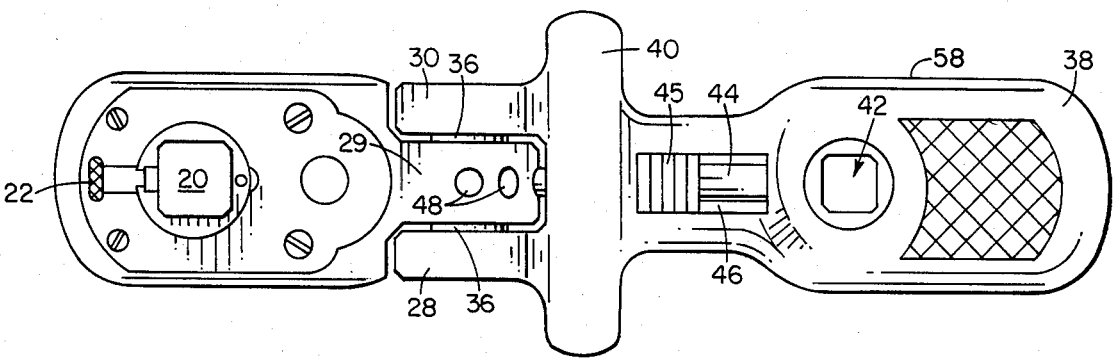
FIG. 1C is a bottom view.

FIGS. 1A and 1B illustrate cylindrically shaped wrist pin pivot bosses 28 and 30 within which is located wrist pivot pin bearing apertures 32 and 34. Said wrist pivot pin bearing apertures 32 and 34 in cylindrically shaped wrist pin pivot bosses 28 and 30 provide an opening for wrist pivot pin 36.

Also illustrated in FIGS. 1A–E are pivotable grip lever handle 38 with cross-bar guard 40. Fixed position tool drive socket recess 42 is shown as passing completely through pivotable grip lever handle 38. Digitably manipulated, spring-loaded, barrel lock bolt plunger 44 is also shown and is operable from either the top or bottom side of device 10. The spring-loaded barrel lock bolt plunger 44 is located in bolt access recess notch 46. Pulling digitably manipulated spring-loaded barrel lock bolt plunger 44 back with the operator's fingers removes the bolt plunger 44 from one of a plurality of bolt lock positioning recesses 48 so that pivotable grip lever handle 38 may pivot on wrist pivot pin 36 to another position where it is once again secured in one of a plurality of bolt-lock positioning recesses 48.

As illustrated in FIG. 3E the innerworkings of digitably manipulated spring-loaded barrel lock bolt plunger 44 is shown in the retracted position thereby allowing lockballs 50 to be pushed inward and be disengaged from an attachable-detachable handle fork, leverage multiplying, extension arm auxiliary handle 52 (discussed more fully hereafter) as well as withdrawing bolt plunger 44 from bolt-lock positioning recess 48 and enabling the pivotable grip lever handle 38 to pivot on wrist pivot pin 36 to a new position.

Reverse lever 54 is illustrated on the upper side of ratchet head 12 and works in the ordinary manner to reverse the direction of socket recess adaptor drive receptable 24 and tool mount-adapter drive probe 20.

Figure 1D:
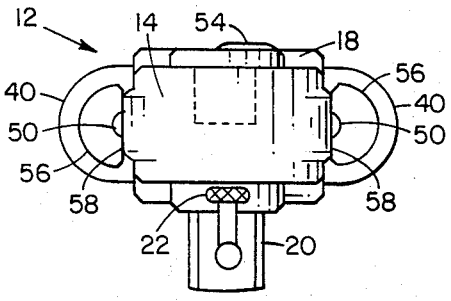
FIG. 1D is an end-on view from the ratchet head end of the device.
Figure 1E:
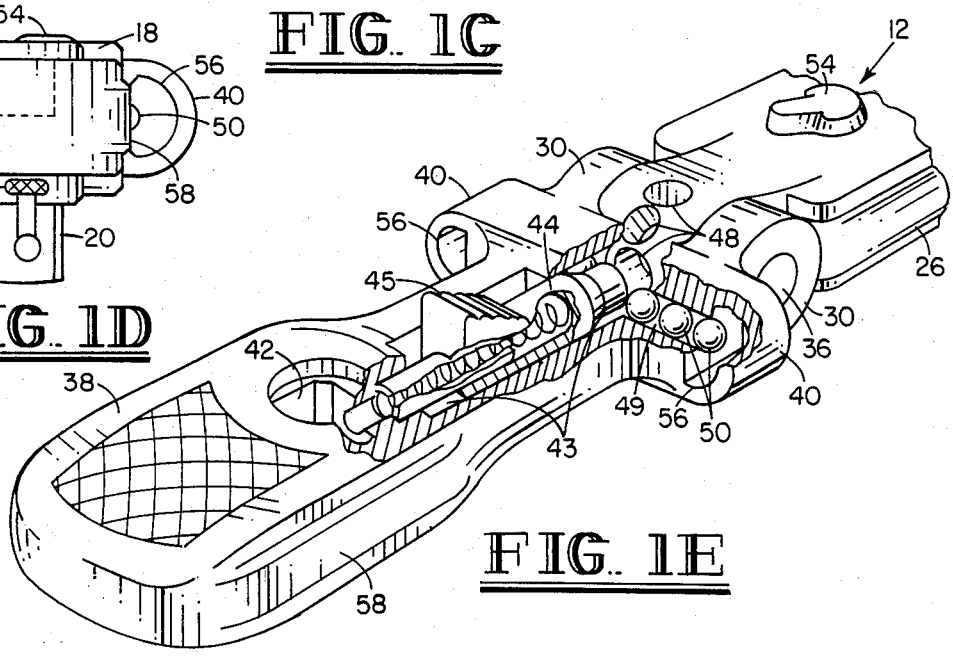
FIG. 1E is a partial section plan view of the grip lever handle illustrating the locking mechanism for the multi-position grip lever handle.

Also illustrated in FIGS. 1D and 1E are semicylindrically shaped bar receiving channels 56 designed to receive attachable-detachable auxiliary handle 52 from either the ratchet head 12 side of device 10 or the pivotable grip lever handle 38 end of device 10. In this regard, rail shaped shoulders 58 are illustrated on pivotable grip lever handle 38.

Figure 2A:
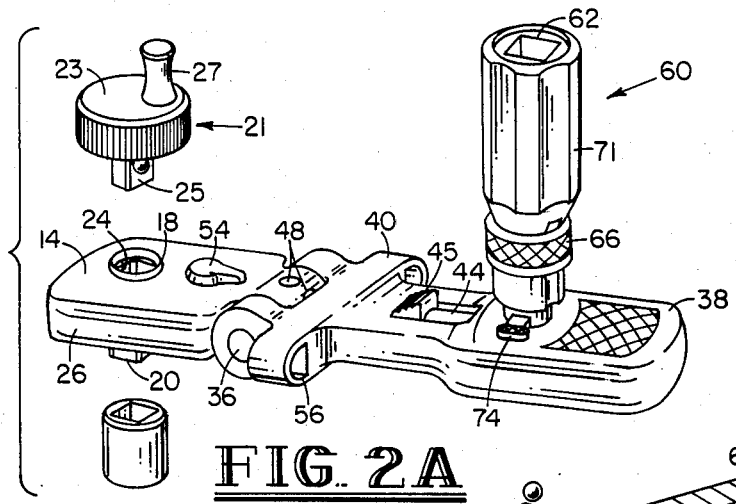
FIG. 2A is a plan view of the device showing it in the crank drive configuration when used with a rotatable handle drive and with a rapid cranking means.

Referring now to FIG. 2, device 10 is illustrated in crank drive configuration in FIG. 2A. In this configuration a rotatable handle drive 60 is shown located in the top of pivotable grip lever handle 38 and held in place by fixed position tool drive socket recess 42. As can be seen, when drive probe 20 is attached to a socket, device 10 can be cranked in either direction to secure or unsecure a bolt or nut depending on which direction reverse lever 54 is positioned.

Figure 2B:
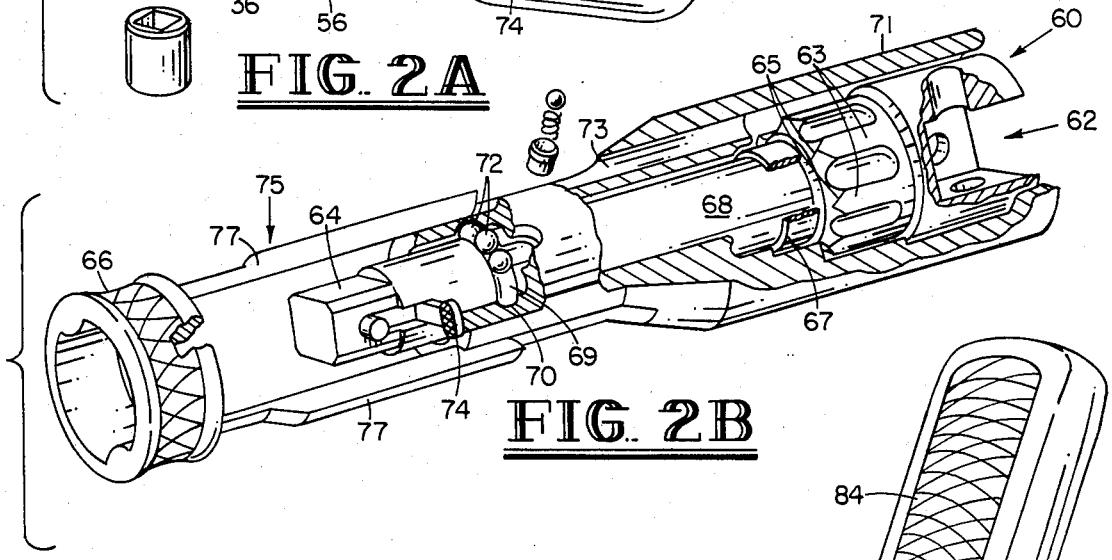
FIG. 2B is a partial section plan view of the rotatable handle drive.
Figure 2C:
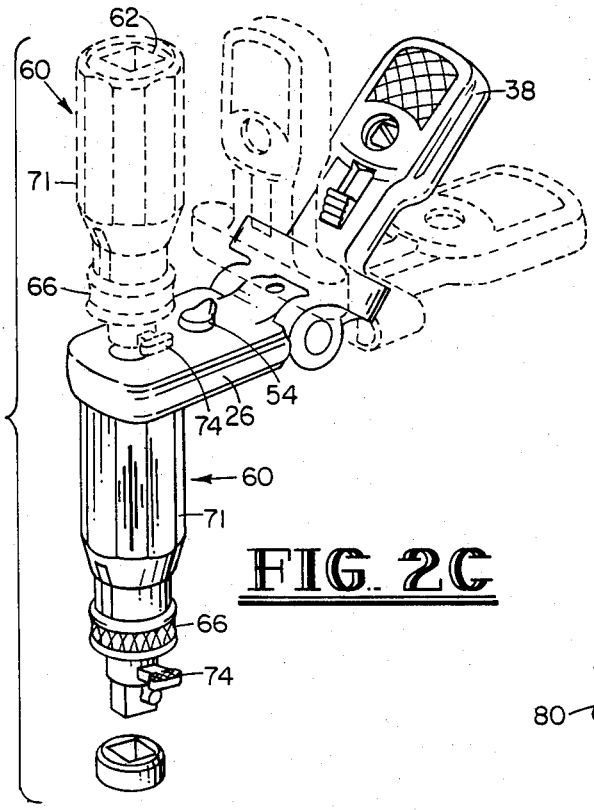
FIG. 2C illustrates the rotatable handle drive in a stationary position in the socket recess in the top of the ratchet head and the shadowy lines illustrate the handle drive either on top of or below the ratchet head. Additionally, the shadowy lines illustrate various positions for the grip lever handle.

FIG. 2C illustrates device 10 with rotatable handle drive 60 inserted in socket recess adaptor drive receptacle 24 (in dotted lines) on top of ratchet head 12. Also shown is rotatable handle drive 60 attached to tool mount-adapter drive probe 20 on the bottom of ratchet head 12. In this configuration the operator can hold his hand steady on rotatable handle drive 60 while ratcheting a nut or bolt on or off with pivotable grip lever handle 38. Pivotable grip lever handle 38 is shown in dotted lines in some of the various positions it is capable to attain. Pivotable grip lever handle 38 may also be pivoted in the downward direction, which is not illustrated in FIG. 2C but is obvious from the design and shown in FIGS. 4C and 3D.

Also illustrated in FIG. 2A is rapid cranking means 21 with base 23, probe 25 and rotatable finger grip 27 which when inserted into drive receptacle 24 provides a means for rapidly running nuts/bolts, etc., on and off.

FIG. 2B is a cutaway view of rotatable handle drive 60 illustrating extension socket recess 62 and extension shaft socket probe 64. Also illustrated in slideable ring 66, extension shaft 68 and ball bearing raceway 70 with ballbearing 72. Also illustrated is socket retainer release means 74. As illustrated, rotatable handle grip 60 operates in a manner well known in the art to enable the handle to slip freely while the extension shaft socket probe 64 rotates while extension socket recess 62 is held in position by tool mount-adapter drive probe 20.

Figure 2D:
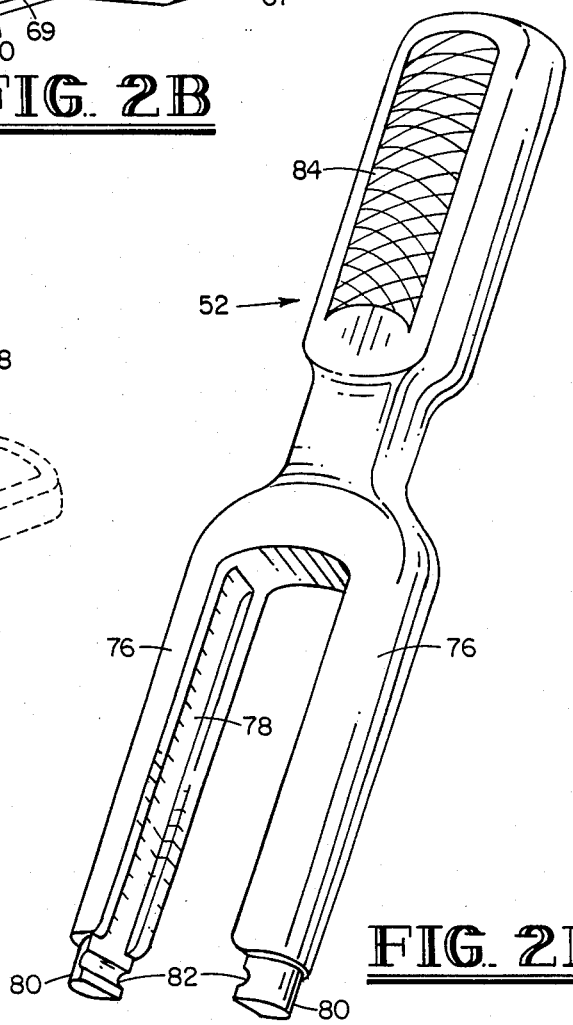
FIG. 2D is a plan view of the forked lever balance auxiliary handle, or "cheater handle".

FIG. 2D illustrates attachable-detachable auxiliary handle 52 consisting of two oppositely positioned parallel fork bars 76 with two parallel oppositely positioned elongated slots 78 which conform to and come in slideable contact with rail shaped shoulders 58 and ratchet head rails 26. Additionally, two oppositely positioned semicylindrical extensions 80 are provided which conform to and are slideably engaged with semicylindrical shaped bar receiving channels 56. Finally, match notches 82 are provided to attachably-detachably engaged with lock balls 50.

Figure 3A:
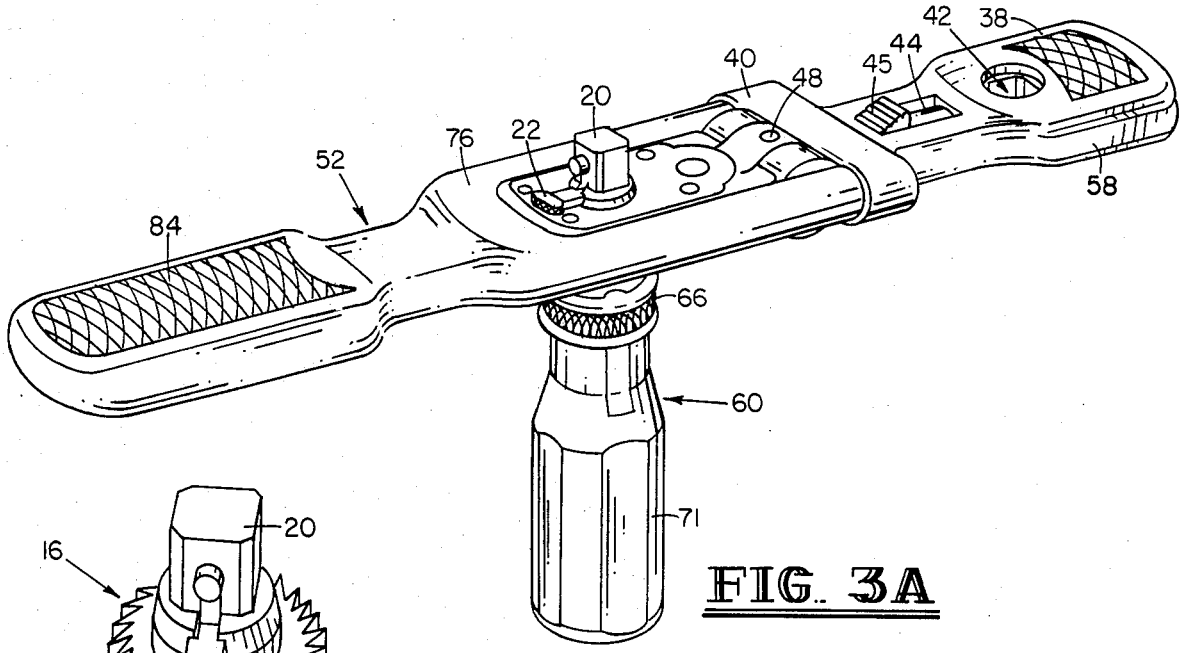
FIG. 3A shows the device in the "spinner" or "flywheel" configuration where the auxiliary handle is secured over the ratchet end of the device.

Referring to FIG. 3A device 10 is illustrated with attachable-detachable auxiliary handle 52 attached to the ratchet head 12 end of device 10 with rotatable handle drive 60 secured to socket recess adaptor drive receptable 24 thereby providing yet another configuration such as provided by a typical tire tool or a spinner tool so that device 10 may be rapidly spun and the bolt or nut rapidly driven on or off while rotatable handle drive 60 is held still.

Figure 3B:
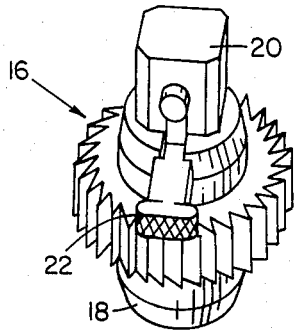
FIG. 3B is a isolated view of the socket probe in the ratchet head demonstrating the ratchet therein.
Figure 3C:
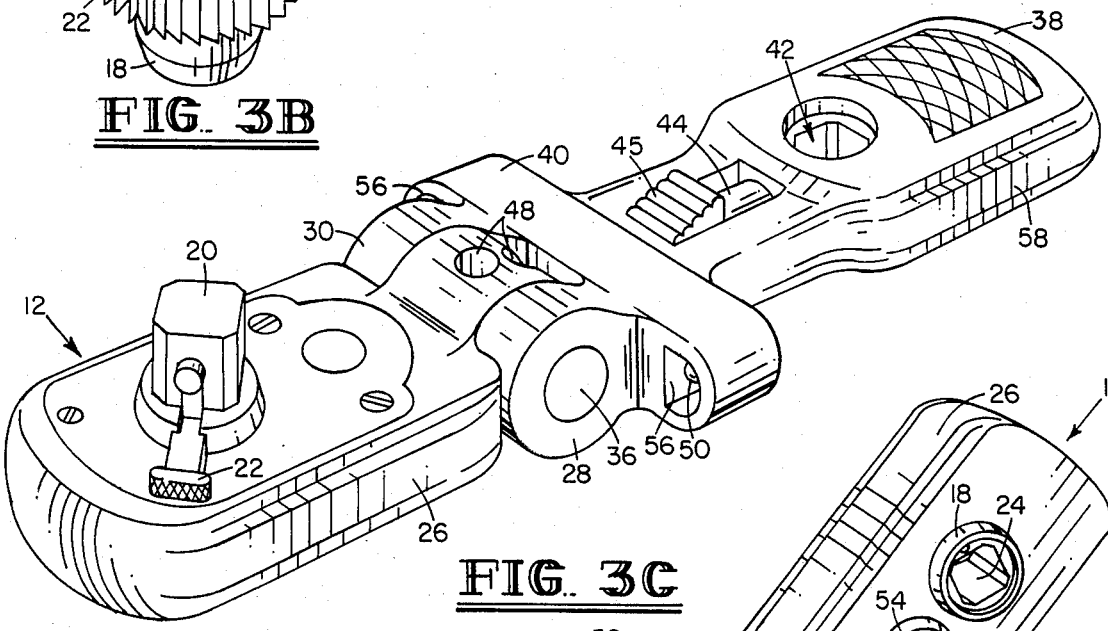
FIGS. 3C and 3D illustrate the device, without the auxiliary handle, in a normal straight position and in one of a plurality of non-straight positions.
Figure 3D:
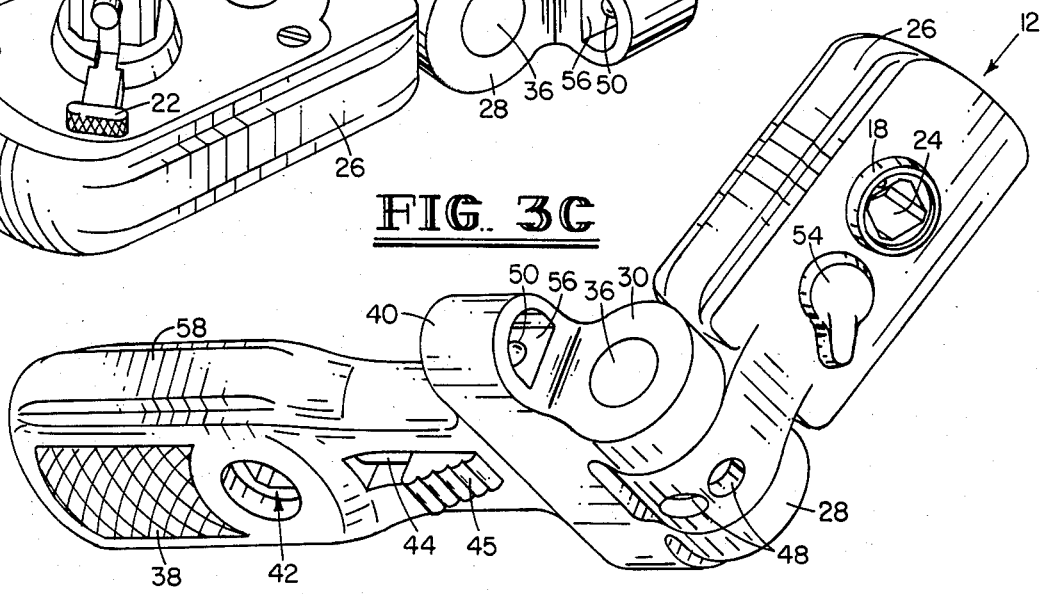

FIG. 3B illustrates the design of reversable ratchet wheel and pawl mechanism 16 such as are known in the art and FIGS. 3C and 3D provide perspective views of the bottom of device 10 and the top of device 10 with pivotable grip lever handle in the downward position (FIG. 3D).

Figure 4A:
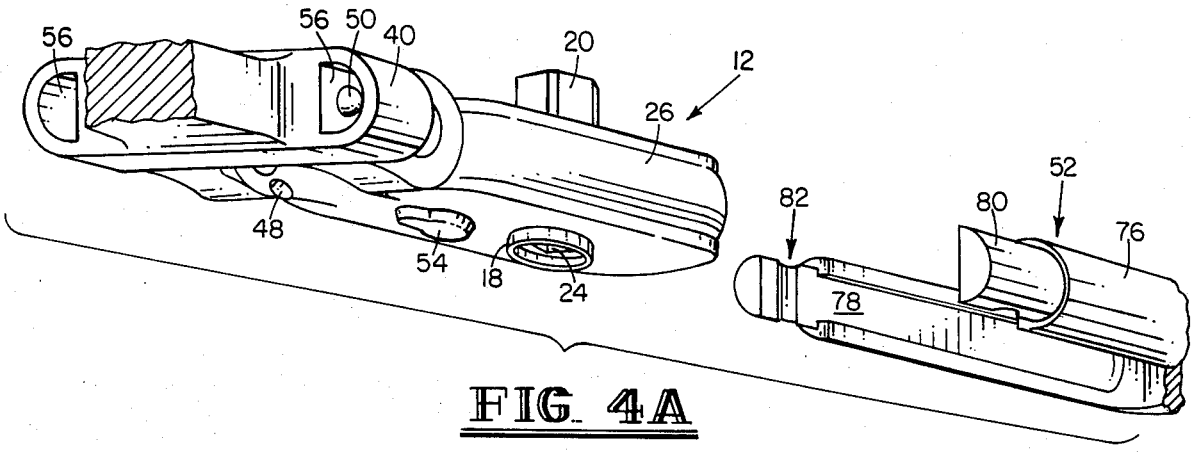
FIG. 4A is a partial cutaway view showing the auxiliary handle being placed in position to be attached to the device from the ratchet head end.
Figure 4B:
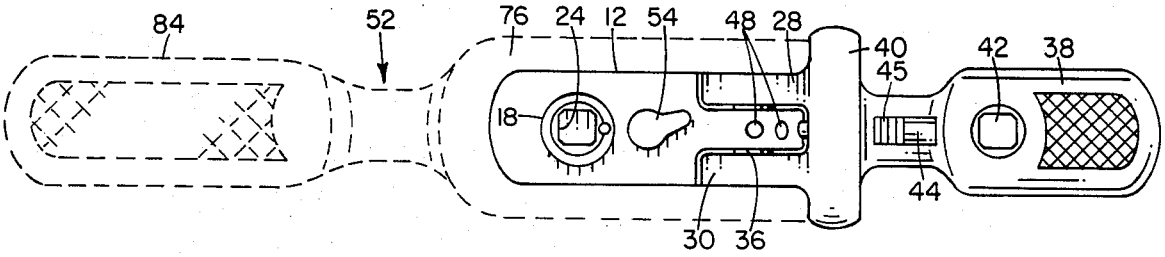
FIG. 4B illustrates the configuration of the device with the auxiliary handle, outlined in dashed lines, in place over the ratchet head end of the device.
Figure 4C:
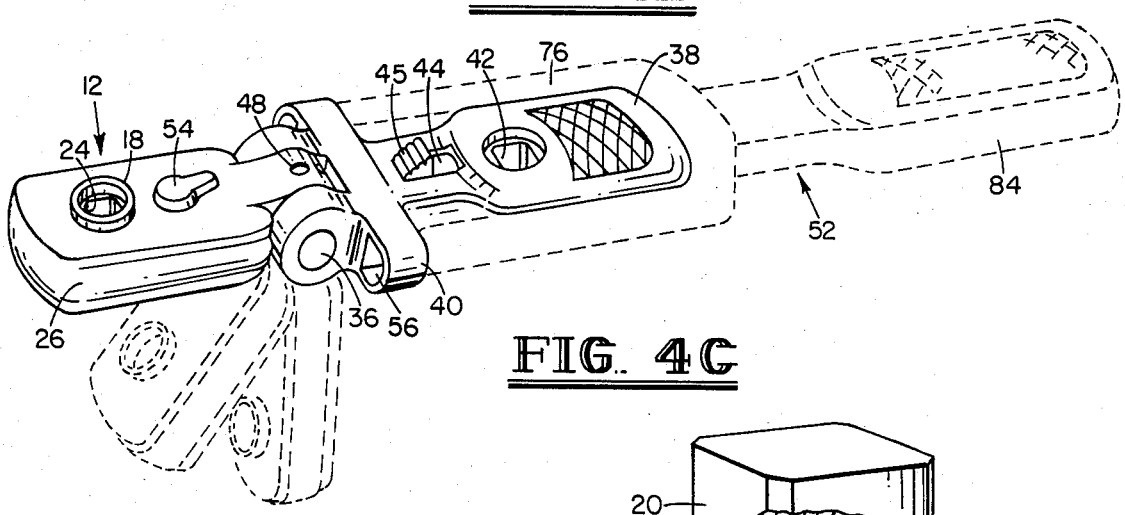
FIG. 4C illustrates the device with the auxiliary handle located over the grip lever handle so that it may be used as a true "cheater" handle.
Figure 4D:
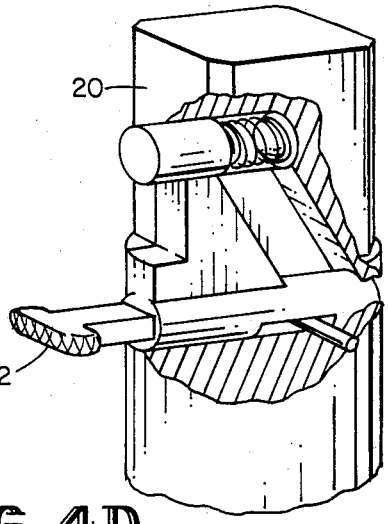
FIG. 4D illustrates the internal workings of the release button on the socket probe.

FIG. 4A is a partial perspective view demonstrating attachable-detachable auxiliary handle 52 in position to be attached to ratchet head 12. FIG. 4B shows attachable-detachable auxiliary handle 52 in dotted lines as attached over ratchet head 12 forming the "spinning" configuration. FIG. 4C shows attachable-detachable auxiliary handle 52 in position over pivotable grip lever handle 38. Additionally, dotted lines illustrate some of the plurality of the positions of a ratchet head 12 when the device 10 is in this configuration. Finally, FIG. 4D is a detail of tool mount-adapter drive probe 20.

As disclosed in FIGS. 1–4 then, a ratchet head 12 comprised of a ratchet head casing 14 is disclosed and made of a rigid material and as being of a generally rectangular shape but having rounded corners, and having a length of about 1½ the width and a thickness of about ⅓ the width. Ratchet head 12 contains a socket ratchet wheel and pawl 16 of conventional design which is mounted permanently around a socket wrench mandrel 18 which extends through the ratchet wheel 16 and the ratchet head casing 14 on the two sides of the casing 14. The socket wrench mandrel 18 has a socket/-tool mount-adapter drive probe 20 with a retainer/-release mechanism 22 on one side of the ratchet head casing 14. Additionally, the device has a socket recess adapter drive receptacle 24 on the opposite side of the ratchet head casing 14. The socket ratchet wheel 16, socket wrench mandrel 18, socket probe 20 and the socket recess 24 are all rigidly affixed together and generally form a figure of revolution with all the described parts having a common centroidal axis.

The ratchet head 12 also contains a ratchet reverse mechanism 54 of conventional design known in the art of which only the reverse lever 54 is visible from the exterior of the device 10. Ratchet head 12 also has a pair of rails 26 molded into the ratchet head casing 14, with the width of the rails 26 being approximately ⅔rds the thickness of the ratchet head casing 14 and a heigth approximately 1/5th of the rail width. The rails 26 are in parallel position to one another but facing outward on opposite sides of the ratchet head casing 14, the center lines of the rails 26 being in a plane perpendicular to the axis of the socket wrench mandrel 18.

Permanently molded to ratchet head 12 is a ratchet head pivot boss 29 which is a cylindrically shaped appendage to the ratchet head 12 attached to the ratchet head 12 and proximal to the ratchet reverse lever 54, the outer surface of the cylindrical shape molded into the ratchet head casing 14 so that the axis of the cylindrical shape is perpendicular to the axis of the socket wrench mandrel 18, and such that the axis of the cylindrical shape lies generally in a plane that is perpendicular to the center line of the socket wrench mandrel 18 and passes through the center of gravity of the ratchet head 12. The height of the above described cylindrically shaped ratchet head pivot boss 29 being approximately ½ the width of the ratchet head casing 14 and having a diameter slightly greater than the thickness of the ratchet head casing 14.

The ratchet head pivot boss 29 has removed from its surface a plurality of bolt lock recesses 48, the recesses 48 being shallow holes drilled part way through the surface of the ratchet heat pivot boss 29 toward and perpendicular to the center line of the ratchet head pivot boss 29 wherein one of the bolt lock recesses 48 has its center line perpendicular to the centerline of the socket wrench mandrel 18 and the remaining bolt lock recesses 48 being drilled at angles to the first, with the centerlines of all bolt lock recesses 48 being in a plane perpendicular to the axis of the ratchet head pivot boss 29 and bisecting the ratchet head pivot boss 29 into two similar cylinders.

Further, there is a wrist pin bearing hole, comprised of wrist pin bearing apertures 32 and 34, which is removed from the ratchet heat pivot boss 29 and which is of cylindrical shape concentric with the cylindrical shape of the ratchet head pivot boss 29 and which has a diameter approximately ½ the diameter of the ratchet head pivot boss 29. Through this wrist pin bearing hole, i.e. the combined wrist pin bearing apertures 32 and 34, is inserted cylindrically shaped wrist pivot pin 36 of such dimension that the wrist pin bearing hole is completely filled and the wrist pivot pin 36 extends out from the ratchet head pivot boss 29 in both directions by some distance, the length of the wrist pivot pin 36 being approximately twice the height of the cylindrical shape of the ratchet head pivot boss 29. The ends of wrist pivot pin 36 extend through a pair of cylindrically shaped wrist pin pivot bosses 28 and 30 mounted on either side of the ratchet head pivot boss 29. The wrist pin pivot bosses 28 and 30 are generally hollow cylinders having outside and inside diameters similar to those described for the ratchet head pivot boss 29 but having cylindrical heights approximately one-half that of the ratchet head pivot boss 29.

The pair of wrist pin pivot bosses 28 and 30 are rigidly attached at a portion of their outer surfaces to a crossbar guard 40. The crossbar guard 40 is a solid bar of rigid material having a generally square cross-section somewhat longer than the width of the ratchet head casing 14 and its length runs parallel to the center line of the wrist pivot pin 36 and is attached to the wrist pin pivot bosses 28 and 30 such that the ratchet head pivot boss 29 can be rotated freely with respect to the crossbar guard 40.

Crossbar guard 40 has removed from it two semicylindrically shaped bar receiving channels 56 which have axes perpendicular to the center line of the wrist pivot pin 36 and which intersect the center line of the crossbar guard 40. The rounded portions of the semicylindrically shaped bar receiving channels face away from one another and the flat portion of the semicylindrically shaped bar receiving channels are generally in the same plane and are parallel to one another.

The crossbar guard 40 also has a ball gallery 49 of cylindrical material removed along the center line of the crossbar guard 40 and extending between the semicylindrically shaped bar receiving channels 56 with the diameter of the ball gallery 49 being approximately 1/6th of the thickness of the crossbar guard 40. The ball gallery 49 includes a plurality of lock balls 50 which comprise a functional unit which provides for a chain reaction lock device.

To the side of the crossbar guard 40 distal to the wrist pin pivot bosses 28 and 30 is attached a grip lever handle 38 which is split generally by a plane that includes the center line of the wrist pivot pin 36 and the crossbar guard 40. The grip lever handle 38 is symmetrical about this just described plane and has a length approximately equal to the sum of the length of the ratchet head casing 14 and the diameter of the ratchet head pivot boss 29. The grip lever handle 38 has cut into it a fixed socket recess 42 which is located approximately midway along the length of the grip lever handle 38 and which has its center line perpendicular to the center line of the crossbar guard 40 and the plane splitting the grip lever handle 38. The grip lever handle 38 is also supplied with a barrel 43 drilled into the crossbar guard 40 and the grip lever handle 38 along the geometric center line of the assembly from the space between the wrist pin pivot bosses 28 and 30 toward, but not intersecting, the fixed socket recess 42. The grip lever handle 38 also has a bolt access recess notch 46, which is a rectangularly shaped opening through the grip lever handle 38 which is open to both sides of the grip lever handle 38, as does the fixed socket recess 42. The bolt access recess notch 46 has its long sides parallel to the long axis of the grip lever handle 38 and extends between, but does not intersect the fixed socket recess 42 and the crossbar guard 40. The bolt access recess notch 46 and the barrel 43 make up a common opening into which is fitted a digitably manipulated springloaded barrel lock bolt plunger 44 which is of generally cylindrical shape and movable within the confines of the barrel 43 and which is springloaded towards the crossbar guard 40 and the wrist pin pivot bosses 28 and 30 end of the grip lever handle 38. Lock bolt plunger 44 engages the bolt lock recesses 48 in the ratchet head pivot boss 29 as well as engaging a train of lock balls 50 placed in the ball gallery passageways 49 of the crossbar guard 40. The lock bolt plunger 44 is supplied with a knurled grip thrust plate 45 which is rigidly affixed to the bolt 44 and which is of such a size and dimension as to move within the bolt assess recess notch 46 and which sets the limits to the back and forth movement of the lock bolt plunger 44.

As an integral part of the invention but not a permanent attachment is an attachable detachable auxiliary handle 52 which is comprised of two spaced apart and parallel positioned fork bars 76 which are substantially longer than width or depth and being of the length slightly greater than the grip lever handle 38 and which are spaced apart at a slightly greater dimension than the width of the ratchet head 12. The interior surfaces of the fork bars 76 contain elongated shaped mating groove slots 78 which extend along the fork bar 76 and which have depths slightly greater than the height of the previously described rails 26 and 58. To the ends of the fork bars 76 are attached semicylindrical locking extensions 80 of such semicylindrical shape and alignment as to just fit into the previously described semicylindrically shaped bar receiving channels 56. Each semicylindrical extension 80 is provided with a match notch 82 which is cut into the innerface of the semicylindrical extensions 80 so that the match notches 82 are perpendicular to the length of the fork bars 76 and which are engaged by and held in place by lockballs 50.

Holding the two fork bars 76 in position is a balance weight handle 84 of approximately rectangular cross section and generally joining the fork bars 76 in which extends parallel to and away from the fork bars 76. As a result of this configuration when auxiliary handle 52 is installed over the ratchet head 12 of the device by engaging the match notches 82 with the lock balls 50, the combined mechanism exhibits a center of gravity along the center line of the socket wrench mandrel 18.

The invention 10 also includes an accessory multiportion extension drive 60 which is comprised of an extension shaft 68 which is several inches in length, the length being several times the diameter and which contains at one end an extension socket recess 62 of square cross section and of such design that it accepts a standard socket probe of conventional design. The end of the extension shaft 68 containing the socket recess 62 is of greater diameter than the remainder of the shaft 68, the portion of greater diameter being in length about twice the depth of the extension socket recess 62. A plurality of splines 63 are built into the enlarged diameter portion but do not encompass the extension socket recess 62. The splines 63 are parallel to the axis of the extension shaft 68 and each spline is fitted with a pyramidal head knife 65 that brings the ends of the socket recess 62 to a relatively sharp point. Around the smaller diameter portion of the extension shaft 68 just adjacent to the enlarged diameter portion is a brass bushing 67. In the surface of the smaller diameter portion of the extension shaft 68 approximately three smaller diameters from the end of the extension shaft 68 distal to the larger diameter portion is cut an inner ball bearing raceway 69 which is cut around the perimeter of the extension shaft 68.

To the end of the extension shaft 68 distal to the extension socket recess 62 is rigidly attached an extension shaft socket probe 64 of a standard cross section and length which contains a socket retainer/release means 74 of standard design.

Around the extension shaft 68 is installed a rotatable handle grip 71 of generally irregular external cylindrical design having a generally hollow interior and having an expanded diameter portion that encloses the extension socket recess 62 and splines 63. The handle grip 71 tapers off to a smaller diameter, thin necked portion having a diameter less than that of the greater diameter portion of the extension shaft 68 so as to enclose the remainder of the extension shaft 68 exclusive of the extension shaft socket probe 64 and socket retainer/release means 74. The rotatable handle grip 71 is rotatable about the extension shaft 68 and engages the extension shaft 68 between the inner cylindrical surface of the expanded diameter portion of the rotatable grip handle 71 and the extension cylindrical surface of the greater diameter portion of the extension shaft 68, the two surfaces forming a bushing type bearing. Further, into the inner cylindrical surface of the thin necked portion of the rotatable handle grip 71 is cut an outer ball bearing raceway 70, such that the outer raceway 70 exactly faces the previously described inner ball bearing raceway 69. Between the two raceways are placed a plurality of bearing balls 72 such that the two raceways 69 and 70 and the bearing balls 72 form a ball bearing unit that positions the thin necked portion of the rotatable handle grip 71 with respect to the extension shaft 68.

Into the rotatable handle grip 71 are cut two spline probe clearance channels 73 which are drilled parallel to the centerline axis of revolution of the rotatable handle grip 71. The spline probe clearance channels 73 are opposite one another in the rotatable handle grip 71 and have interior walls the same distance apart as are the opposite interior bottoms of the spline openings 63 and having outer surfaces inside the expanded diameter portion of the rotatable grip 71 but having part of the drill hole exposed to the outside surface along the thin necked portion. Into the two spline probe clearance channels 73 is installed a spline engagement fork 75 comprised of two spline probes of generally rod like structure being parallel to one another and being spaced apart the same distance as are the two spline probe clearance channels 73, being insertable into the two spline probe clearance channels 73 and into any two opposite spline openings 63. The spline probes 75 are of sufficient length to completely engage the spline openings 63 and to extend outside of the expanded diameter portion of the rotatable handle grip 71 and over the thin necked portion. The spline probes 75 are held together by a slideable ring 66 of generally thin sectioned hollow cylindrical shape. The spline probes 75 and the slideable ring 66 being bonded together as an integral part and the inside diameter of the slideable ring 66 being of such dimension that the slideable ring 66 may just freely pass over the thin necked portion of the rotatable handle grip 71.

The present invention provides a multipurpose socket ratchet wrench with a unique ability to receive any standard drive tool directly on top of the ratchet head. This feature alone sets the invention apart from the prior art. This feature in conjunction with the ability of the invention to allow for utilization in an extremely wide variety of widely occurring mechanical situations makes it doubly unique. In its standard configuration, the ratchet head and the grip handle can be utilized as an ordinary ratchet tool might be utilized. However, this invention provides for rugged durability and safety while protecting the operator's hands by a unique bar guard. The normal "knuckle busting" is greatly diminished when utilizing this tool. The unique ability of the device to assume a plurality of angled positions which are safely and securely maintained by means of a bolt and bolt lock recesses enables the device to be utilized safely in awkward positions as well. The combination of the standard device in conjunction with an auxiliary forked lever balance handle enables the user to produce several useful configurations that are not the normal "jury rigged" systems that most operators resort to out of necessity when using previously existing devices. That is, when utilizing the forked lever balance auxiliary handle held securely in place over the grip lever handle the device is configured in a classic "cheater bar" position with the advantage of safe and secure retention of the "cheater bar" on the device. This configuration also allows the ratchet head to be angled in a plurality of various angles so that awkwardly placed bolts may be reached as well. Further, when the forked lever balance handle is attached over the ratchet head end of the device, a "spinner" configuration is attained so that the weighted balance handle provides a means for rapidly spinning nuts/bolts, etc., on and off a project.

When the device is utilized in conjunction with a multiposition extension drive an even greater variety of useful mechanical configurations may be attained. When the extension drive is inserted in the stationery fixed socket recess of the grip handle and the socket probe on the ratchet head is engaged with a socket, a "crank drive" configuration is attained so that the subject bolt may be cranked into position. When the extension drive is located in either the top of the ratchet head or in the bottom of the ratchet head yet another configuration is provided wherein the extension drive may be held securely in one position while the grip handle is utilized to ratchet a bolt on or off.

Still another configuration is provided by inserting a rapid cranking means into the socket recess in the top of the ratchet head to provide a rapidly rotatable means to run nuts/bolts on and off.

While the present invention has been disclosed in connection with the preferred embodiment thereof, it should be understood that there may be other embodiments which fall within the spirit and the scope of the invention as defined by the following claims.

What is claimed is:

1. An improved multipurpose socket ratchet wrench comprised of:

A. a ratchet head comprised of a:

(1) ratchet head casing made of rigid material being of generally rectangular shape but having rounded corners, and having length of about one and one-half the width and thickness about one-third the width, and containing a (2) socket ratchet wheel and pawl of conventional design, said ratchet wheel being mounted permanently around (3) a socket wrench mandrel which extends through said ratchet wheel and said ratchet head casing on two sides of said casing, said socket wrench mandrel exhibiting (4) a socket probe with a retainer/release mechanism on one side of said ratchet head casing and exhibiting a (5) socket recess on the opposite side of said ratchet head casing, said socket ratchet wheel, socket wrench mandrel, socket probe and said socket recess all rigidly affixed together and generally forming a figure of revolution with all said described parts having a common centroidal axis, said ratchet head also containing (6) a ratchet reverse mechanism of conventional design of which only a reverse lever is visable from the exterior of said wrench, and said ratchet head also having (7) a pair of rails moulded into said ratchet head casing, the width of said rails being approximately two-thirds the thickness of said ratchet head casing and height approximately one-fifth of said rail width, said rails being positioned parallel to one another but facing outward on opposite ratchet head casing sides, the centerlines of said rails being in a plane perpendicular to the axis of said socket wrench mandrel, and to said ratchet head is permanently moulded B. A ratchet head pivot boss, a cylindrically shaped appendage to said ratchet head attached to said ratchet head and proximal to said ratchet reverse mechanism, the outer surface of the cylindrical shape moulding into said ratchet head casing such that the axis of the cylindrical shape is perpendicular to the axis of said socket wrench mandrel, and such that the axis of the cylindrical shape lies generally in a plane that is perpendicular to the centerline of said socket wrench mandrel and passes through the center of gravity of said ratchet head assembly group, the height of said cylindrically shaped ratchet head pivot boss being approximately one-half the width of said ratchet head casing and having a diameter slightly greater than the thickness of said ratchet head casing, said ratchet head pivot boss having removed from it a (1) wrist pin bearing hole, said bearing hole being of cylindrical shape and being concentric with said cylindrical shape of said ratchet head pivot boss and having a diameter approximately one-half the diameter of said ratchet head pivot boss having removed from its surface a plurality of (2) bolt lock recesses, said recesses being shallow holes drilled part-way through the surface of said ratchet head pivot boss towards and perpendicular to the centerline of said ratchet head pivot boss, one of said bolt lock recesses having its centerline perpendicular to the centerline of said socket wrench mandrel and the remaining bolt lock recesses being drilled at angles to the first, with centerlines of all bolt lock recesses being in a plane perpendicular to the axis of said ratchet head pivot boss and bisecting said ratchet head pivot boss into two similar cylinders, and through said wrist pin bearing hole is inserted C. a cylindrically shaped wrist pin of such dimension that said wrist pin bearing hole is completely filled and said wrist pin extends out from said ratchet head pivot boss in both directions by some distance, the length of said wrist pin being approximately twice the height of the cylindrical shape of said ratchet head pivot boss, the ends of said wrist pin extending through D. a pair of wrist pin pivot bosses mounted on either side of said ratchet head pivot boss, said wrist pin pivot bosses being generally hollow cylinders having outside and inside diameters similar to those described for said ratchet head pivot boss but having cylindrical heights approximately one-half that of said ratchet head pivot boss, said pair of wrist pin pivot bosses being rigidly attached at a portion of their outer surfaces to a E. cross bar guard, a solid bar of rigid material having a generally square cross-section somewhat longer than the width of said ratchet head casing having its length running parallel to the centerline of said wrist pin and being attached to said wrist pin pivot bosses such that said ratchet head pivot boss can be rotated freely with respect to said cross bar guard, said cross bar guard having removed from it two.

(1) semicylindrical shaped bar receiving channels perpendicular to the center line of said wrist pin and intersecting the centerline of said cross bar guard, and having rounded portions facing away from one another and flat portions of said semicylinders being generally in the same planes as are the bases of said rails and said flat portions of said semicylinders being parallel to one another, said cross bar guard also having a (2) ball gallery of cylindrical material removed along the centerline of said cross bar guard, and extending between said semicylindrical bar receiving channels, the diameter of said ball gallery being approximately one-sixth of the thickness of said cross bar guard, said ball gallery including a plurality of (3) lock balls, the functional unit comprised of said ball gallery and said plurality of lock balls being a chain reaction lock device, and to the side of said cross bar guard distal to said wrist pin pivot bosses is attached a F. grip lever handle, being split generally by a plane that includes the centerlines of said wrist pin and said cross bar guard, said grip lever handle being symetrical about the just described plane, and having length approximately equal to the sum of the length of said ratchet head casing and the diameter of said ratchet head pivot boss, said grip lever handle having cut into it a (1) fixed socket recess located approximately midway along the length of said grip lever handle and having its centerline perpendicular to the centerline of said cross bar guard and the plane splitting said grip lever handle, said grip lever handle being also supplied with a (2) barrel drilled into said cross bar guard and said grip lever handle along the geometric centerline of said wrench from the space between said wrist pin pivot bosses toward, but not intersecting, said fixed socket recess, said grip lever handle also being supplied with a (3) bolt access notch, a rectangular shaped opening through said grip lever handle opening to the same sides of said grip lever handle as does said fixed socket recess and having its long sides parallel to the long axis of said grip lever handle and extending between but not intersecting said fixed socket recess and said cross bar guard, said bolt access recess notch and said barrel making up a common opening into which is fitted a G. Bolt, of generally cylindrically shape movable within the confines of said barrel and being spring loaded toward said cross bar guard and wrist pin pivot bosses' end of said grip lever handle, and engaging said bolt lock recesses in said ratchet head pivot boss, and engaging a train of lock balls placed in said ball galleries of said cross bar guard, said bolt being supplied with a H. Knurled grip thrust plate, rigidly affixed to said bolt and of such size and dimension so as to move within said bolt access recess notch and setting limits to the back and forth movement of said knurled grip thrust plate unit assembly; and, as an integral part of the invention but not a permanent attachment is, a I. Forked lever/balance auxiliary handle comprised of two (1) fork bars substantially longer than width or depth and being of length slightly greater than said grip lever handle, and spaced apart at a slightly greater dimension than the width of said ratchet head, the interior surfaces of said fork bars containing (2) elongated slots extending along said fork bars having depths slightly greater than the height of said rails and having widths slightly greater than the width of said rails, and to the ends of said fork bars are (3) semicylindrical extensions of such semicylindrical shape and alignment so as to just fit into said semicylindrical recess notches, each said semicylindrical extension being provided with (4) a match notch cut into the inner face of said semicylindrical extensions so that said match notches are perpendicular to the length of said fork bars, and adjoining and holding said two fork bars in position is a (5) balance weight handle of approximately rectangular cross section and generally joining said fork bars and extending parallel to and away from said fork bars, said fork bars of said auxiliary handle being such that when installed over said ratchet head and engaging said semicylindrical notches that said wrench exhibits a center of gravity along the centerline of said socket wrench mandrel.

2. The improved socket ratchet wrench described in claim 1 but including an accessory multiportion extension drive comprised of A. an extension shaft several inches in length, the length several times the diameter containing at one end an (1) extension socket recess of square cross section of such design that it will accept a standard socket probe, the end of said extension shaft containing said socket recess being of greater diameter than the remainder of said shaft, the portion of greater diameter being in length about twice the depth of said extension socket recess, having an even plurality of (2) splines built into said enlarged diameter portion not encompassing said extension socket recess, said splines being parallel to the axis of said extension shaft, each spline being fitted with a (3) pyramidal head knife that brings the ends of said socket recess to a relatively sharp point, and around said smaller diameter portion of said extension shaft just adjacent to said enlarged diameter portion is a (4) brass bushing, and into the surface of said smaller diameter portion of said extension shaft approximately three smaller diameters from the end of said extension shaft distal to said larger diameter portion is cut an (5) inner ball bearing raceway cut around the perimeter of said extension shaft, and to the end of said extension shaft distal to said extension socket recess is rigidly attached an (6) extension shaft socket probe of standard cross section and length and containing a (7) socket retainer/release means of standard design, and around said extension shaft is installed a B. rotatable handle grip of generally irregular external cylindrical design having a generally hollow interior and having an expanded diameter portion that encloses said extension socket recess and splines, said handle grip tapering off to a smaller diameter thin necked portion having a diameter less than that of said greater diameter portion of said extension shaft, to enclose the remainder of said extension shaft exclusive of said extension shaft socket probe and socket retainer/release means, with said rotatable handle grip rotatable about said extension shaft and engaging said extension shaft between an (1) inner cylindrical surface of said expanded diameter portion of said rotatable grip handle and the extension cylindrical surface of said greater diameter portion of said extended shaft, these two surfaces forming a bushing type bearing; and into said inner cylindrical surface of said thin necked portion of said rotatable handle grip is cut a (2) outer ball bearing raceway, such that said outer raceway exactly faces said inner ball bearing raceway, and between the two said raceways are placed a plurality of (3) bearing balls, such that the two said raceways and said bearing balls form a ball bearing unit that positions said thin necked portion of said rotatable handle grip with respect to said extension shaft; and into said rotatable handle grip are cut (4) two spline probe clearance channels drilled parallel to the centerline axis of revolution of said rotatable handle grip, said spline probe clearance channels being opposite one another in said rotatable handle grip and having interior walls the same distance apart as are the opposite interior bottoms of said spline openings and having outer surfaces inside said expanded diameter portion of said rotatable handle grip but having part of the drill hole exposed to the outside surface along the thin necked portion; and into said two spline probe clearance channels is installed a C. spline engagement fork comprised of two (1) spline probes of generally rod like structure being parallel to one another and being spaced apart the same distance as are said two spline probe clearance channels, being insertive into said spline probe clearance channels and into any two of said opposite spline openings, said spline probes being of sufficient length to completely engage said spline openings and to extend outside of said expanded diameter portion of said rotatable handle grip and over said thin necked portion, said spline probes being held together by a (2) slidable ring, of generally thin sectioned hollow cylindrical shape, said spline probes and said slidable ring being bonded together as an integral part, and said inside diameter of said slideable ring being of such dimension that said slideable ring may just freely pass over said thin necked portion of said rotatable handle grip.

3. The improved socket ratchet wrench described in claim 1 but including a removeably detachable rapid cranking means secured to said ratchet head at said mandrel and said socket recess comprised of a cranking base, a socket probe attached underneath said base and a rotatable cranking finger grip attached in an off center manner to the upperside of said base so that a means for rapidly running nuts, bolts and the like on and off is provided.

* * * * *